US005564404A

United States Patent [19]

Takahashi et al.

[11] Patent Number: 5,564,404

[45] Date of Patent: Oct. 15, 1996

[54] AIR/FUEL RATIO CONTROL SYSTEM OF INTERNAL COMBUSTION ENGINE

[75] Inventors: Hideaki Takahashi, Isehara; Kimiyoshi Nishizawa, Yokohama, both of Japan

[73] Assignee: Nissan Motor Co., Ltd., Kanagawa, Japan

[21] Appl. No.: 527,969

[22] Filed: Sep. 14, 1995

[30] Foreign Application Priority Data

Sep. 20, 1994 [JP] Japan ..... 6-224429
Sep. 20, 1994 [JP] Japan ..... 6-224430

[51] Int. Cl.[6] ..... F02D 41/14

[52] U.S. Cl. ..... 123/676; 123/491; 123/686; 60/285

[58] Field of Search ..... 123/676, 685, 123/686, 690, 491; 60/274, 284, 285

[56] References Cited

U.S. PATENT DOCUMENTS 3,949,551 4/1976 Eichler et al. ..... 123/491 X
4,222,236 9/1980 Hegedus et al. ..... 60/274
4,388,803 6/1983 Furuya et al. ..... 60/284
4,706,633 11/1987 Nakagawa ..... 123/491
5,211,011 5/1993 Nishikawa et al. ..... 60/284
5,483,946 1/1996 Hamburg et al. ..... 123/686

FOREIGN PATENT DOCUMENTS 62-17341 1/1987 Japan .

*Primary Examiner*—Tony M. Argenbright
*Attorney, Agent, or Firm*—Lowe, Price, LeBlanc & Becker

[57] ABSTRACT

A lean air/fuel ratio control device is provided for feeding the engine with a mixture of a desired lean air/fuel ratio for a given time from the time on which the engine is started. A stoichiometric air/fuel ratio control device is provided for feeding the engine with a mixture of a substantially stoichiometric air/fuel ratio once the given time passes. A temperature sensor is provided for sensing the temperature of cooling water of the engine at the time when the engine is just started. A control unit is provided for varying the given time in accordance with the temperature sensed by the temperature sensor. The given time may be varied in accordance with the activity of the oxygen sensor or the temperature of exhaust gas from the engine.

6 Claims, 10 Drawing Sheets

AIR/FUEL RATIO CONTROL SYSTEM OF INTERNAL COMBUSTION ENGINE

BACKGROUND OF THE INVENTION

1. Field of the Invention

The present invention relates in general to air/fuel ratio control systems of an internal combustion engine, and more particularly to air-fuel ratio control systems of a type which can selectively feed the engine with a mixture of higher (or lean) air/fuel ratio and a mixture of stoichiometric air/fuel ratio.

2. Description of the Prior Art

Hitherto, for improvement in fuel consumption, a so-called "lean-burn engine" has been proposed and put into practical use particularly in the field of wheeled motor vehicles. The lean-burn engine can operate on a mixture which is extremely leaner than a mixture of stoichiometric air/fuel ratio (viz., 14.7/1). For operation of the lean-burn engine, a lean mixture having air/fuel ratio of about 20/1 to 25/1 is usually used. In fact, for the operation, an air/fuel ratio control system is used which, under low rotation and low load condition of the engine, feeds the engine with such a lean mixture for improving fuel consumption, and which, with increase of load of the engine, gradually makes the air/fuel ratio of the mixture richer toward the stoichiometric ratio.

As is known, when the engine operates on a mixture of stoichiometric air/fuel ratio, a three-way catalytic converter, which is installed in the exhaust line of the engine, assuming its activated state can exhibit the maximum conversion efficiency (or purifying efficiency) against CO, HC and NOx contained in the exhaust gas from the engine.

In such air/fuel ratio control systems, there has been proposed a type by Japanese Patent First provisional Publication 62-17341 in which until the temperature of the engine cooling water rises to a predetermined degree, the control is so made that the engine operates on a lean mixture and once the temperature exceeds the predetermined degree, the control is switched over to a control wherein the engine operates on a mixture of stoichiometric air/fuel ratio.

However, even the air/fuel ratio control system proposed by the Publication have failed to exhibit a satisfied performance in emission control. That is, due to its inherent construction, it sometimes occurs that even when the catalytic converter has come into its activated state, the temperature of the engine cooling water does not reach the predetermined degree due to a very cold surrounding or the like. Under this condition, the engine is forced to continue the lean mixture operation, so that the catalytic converter in activated state can not exhibit a satisfied purifying efficiency against the exhaust gas emitted from the engine.

For ease of description, in the following, a control wherein an engine is controlled to operate on a lean mixture will be referred to as "a lean air/fuel ratio control" and a control wherein the engine is controlled to operate on a mixture of stoichiometric air/fuel ratio will be referred to as "a stoichiometric air/fuel ratio control".

SUMMARY OF THE INVENTION

It is therefore an object of the present invention to provide an air/fuel ratio control system of an internal combustion engine, which is free of the above-mentioned drawback.

That is, according to the present invention, there is provided an air/fuel ratio control system of an internal combustion engine, which, irrespective of the starting condition of the engine, can timely switch the lean air/fuel ratio control to the stoichiometric air/fuel ratio control for achieving both improved fuel consuption and satisfied exhaust purification.

More specifically, according to the present invention, there is provided an air/fuel ratio control system of an internal combustion engine, which effects the following operation. That is, until the time when, after starting of the engine, the catalyst of the converter becomes sufficiently activated, a lean air/fuel ratio control is carried out, and once the catalyst becomes sufficiently activated, the control is automatically switched to a stoichiometric air/fuel ratio control.

According to a first aspect of the present invention, there is provided, in an internal combustion engine having a three-way catalytic converter in an exhaust line thereof, an air/fuel ratio control system which comprises lean air/fuel ratio control means for feeding the engine with a mixture of a desired lean air/fuel ratio for a given time from the time on which the engine is started; stoichiometric air/fuel ratio control means for feeding the engine with a mixture of a substantially stoichiometric air/fuel ratio once the given time passes; temperature sensing means for sensing the temperature of cooling water of the engine at the time when the engine is just started; and control switching means for varying the given time in accordance with the temperature sensed by the temperature sensing means.

According to a second aspect of the present invention, there is provided, in an internal combustion engine having a three-way catalytic converter and an oxygen sensor in an exhaust line thereof, an air/fuel ratio control system which comprises lean air/fuel ratio control means for feeding the engine with a mixture of a desired lean air/fuel ratio for a given time from the time on which the engine is started; stoichiometric air/fuel ratio control means for feeding the engine with a mixture of a substantially stoichiometric air/fuel ratio once the given time passes; activity sensing means for sensing the activity of the oxygen sensor; and control switching means for varying the given time in accordance with the oxygen sensor activity sensed by the activity sensing means.

According to a third aspect of the present invention, there is provided, in an internal combustion engine having a three-way catalytic converter and an exhaust gas temperature sensor in an exhaust line thereof, an air/fuel ratio control system which comprises lean air/fuel ratio control means for feeding the engine with a mixture of a desired lean air/fuel ratio for a given time from the time on which the engine is started; stoichiometric air/fuel ratio control means for feeding the engine with a mixture of a substantially stoichiometric air/fuel ratio once the given time passes; temperature sensing means for sensing the temperature of exhaust gas from the engine; and control switching means for varying the given time in accordance with the exhaust gas temperature sensed by the temperature sensing means.

DETAILED DESCRIPTION OF THE EMBODIMENTS

Figure 1:
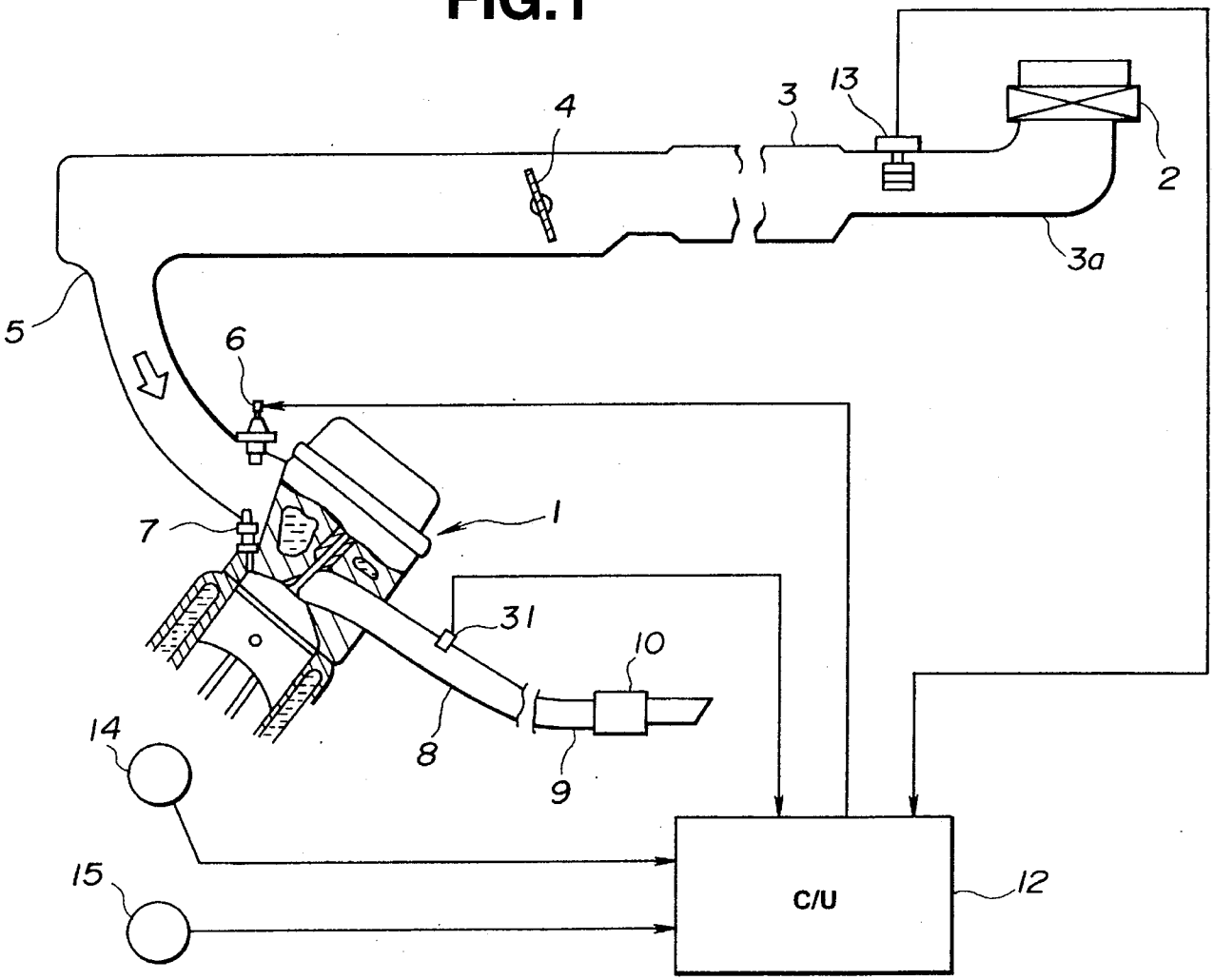
FIG. 1 is a schematic view of an internal combustion engine system to which the present invention is practically applied.

Referring to FIG. 1, there is schematically shown an internal combustion engine system to which various embodiments of the present invention are practically applied.

In the drawing, denoted by numeral 1 is a four-cylinder type internal combustion engine.

An air cleaner 2, an air intake duct 3, a throttle valve 4 and an intake manifold 5 constitute an intake system through which air is fed to the engine 1. Four fuel injection valves 6 are mounted to respective branch portions of the intake manifold 5 to feed the four cylinders with fuel respectively. Each fuel injection valve 6 is an electromagnetic type which is opened when energized and closed when deenergized. Upon receiving a drive pulse signal from an after-mentioned control unit 12, the open/close operation of each fuel injection valve 6 is controlled so that a predetermined amount of pressurized fuel is intermittently injected into the corresponding cylinder of the engine 1. Although not shown in the drawing, a fuel line extending from a fuel pump is connected to the fuel injection valves 6, and a pressure regulator is mounted on the fuel line to regulate the pressure applied to fuel directed to each fuel injection valve 6.

Each cylinder of the engine 1 is equipped at a combustion chamber with an ignition plug 7 by which the air/fuel mixture fed to the combustion engine is ignited.

An exhaust manifold 8, an exhaust duct 9 and a three-way catalytic converter 10 constitute an exhaust system through which exhaust gas from the engine 1 is discharged to atmospheric air. The three-way catalytic converter 10 can purify the exhaust gas by oxidizing CO, HC and reducing NOx contained in the exhaust gas.

The control unit 12 is a microcomputer which comprises a CPU (central processing unit), a ROM (read only memory), a RAM (random access memory), an A/D (analog/digital) converter and input/output interfaces. As will be described hereinafter, by processing information signals issued from various sensors, the control unit 12 controls operation of the fuel injection valves 6.

The sensors are an air-flow meter 13, a crankangle sensor 14, a cooling water temperature sensor 15 and an oxygen sensor 31. The air-flow meter 13 is installed in the air intake duct 3 and issues a signal representing an intake air rate "Q". The crankangle sensor 14 issues a reference angle signal "REF" at each reference crankangle position (viz., at top-dead-center position in the invention) and issues a unit angle signal "POS" each rotation of 1 or 2 degrees in rotation angle. It is to be noted that by measuring the cycle of the reference angle signal "REF" or by measuring the number of the unit angle signals "POS" in a given period, an engine rotation speed "Ne" can be derived. The cooling water temperature sensor 15 detects the temperature of cooling water in a water jacket of the engine 1. The oxygen sensor 31 is mounted to a branch junction portion of the exhaust manifold 8 to serve as an air/fuel ratio detecting means. The oxygen sensor 31 varies its output in accordance with the oxygen concentration in the exhaust gas. For example, the oxygen sensor 31 may be of a type which produces an electromotive force in accordance with the rate of the oxygen concentration in the exhaust gas relative to that of atmospheric air. As will be described in detail hereinafter, based on the output from the oxygen sensor 31, a feedback control is carried out for controlling the air/fuel ratio of mixture to a desired ratio (viz., stoichiometric ratio or lean ratio).

In the following, the present invention will be described with reference to the drawings.

Figure 2:
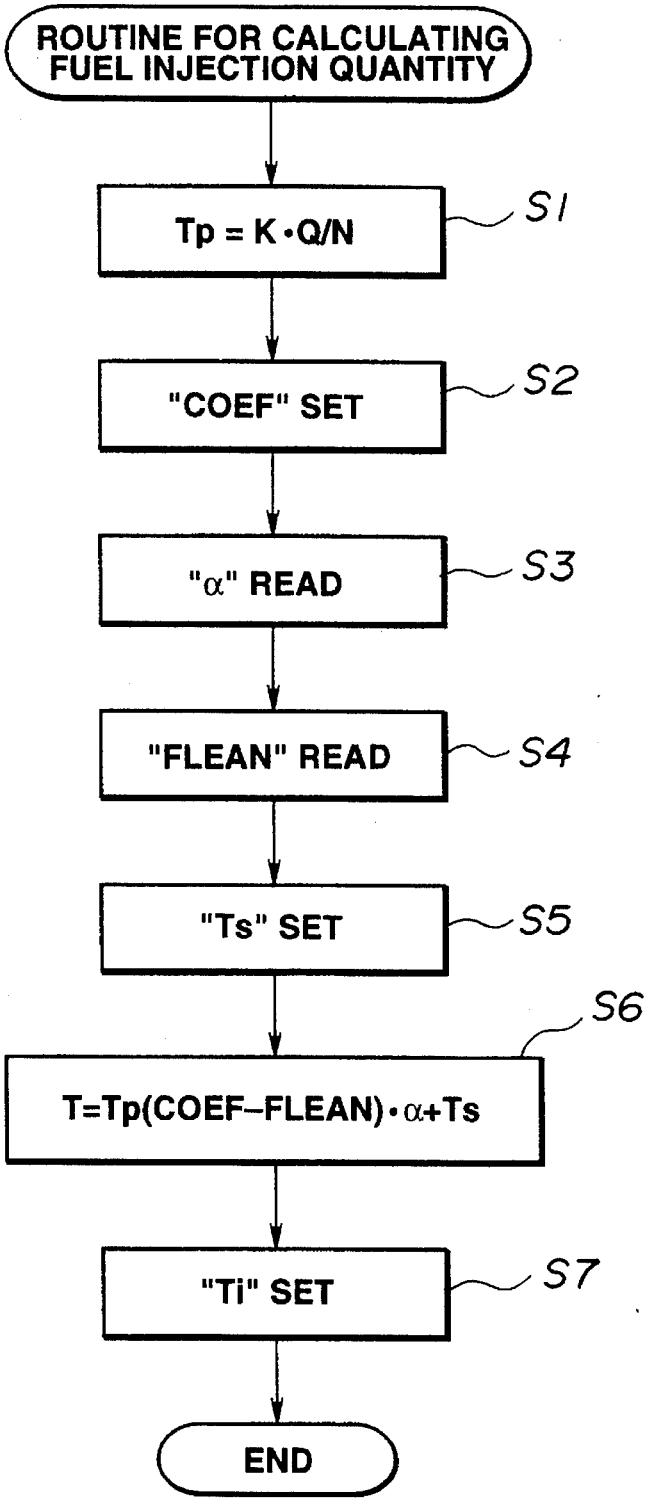
FIG. 2 is a flowchart of programmed operation steps for carrying out a fuel injection control according to the present invention.

In the present invention, for controlling a fuel injection to the engine 1, the CPU of the microcomputer of the control unit 12 carries out programmed operation steps of the flowchart of FIG. 2, which steps are memorized by the ROM.

As will become apparent as the description proceeds, in the present invention, a lean air/fuel ratio control means, a stoichiometric air/fuel ratio control means and a switching control means are provided by suitable programs of operation steps (viz., software) which are executed by the microcomputer of the control unit 12.

The programmed operation steps of FIG. 2 constitute a general routine for calculating a fuel injection quantity. The routine is executed every given period, for example, at intervals of 10 milliseconds.

At step S1, based on both the intake air rate "Q" detected by the air-flow meter 13 and the engine rotation speed "N" derived from the signals of the crankangle sensor 14, a reference fuel supply quantity "Tp" is calculated from the following equation.

$$Tp=K\cdot Q/N \quad (1)$$

wherein:

K: constant

At step S2, based on the cooling water temperature "Tw" detected by the cooling water temperature sensor 15 and other information sensed by the other sensors, various correction factors "COEF" are derived.

At step S3, a feedback correction factor "α" derived by a feedback correction factor deriving routine is read.

At step S4, a lean correction factor "FLEAN" to the reference fuel supply quantity is looked up from a given map. The lean correction factor "FLEAN" is used for making the air/fuel ratio leaner during an engine warm-up period just after starting of the engine. When the engine is under a stoichiometric air/fuel ratio control, the lean correction factor "FLEAN" is set 0 (zero) percent.

At step S5, based on the voltage possessed by a battery, a voltage correction amount "Ts" is set. The correction amount "Ts" is used for correcting a fluctuation in the fuel injection quantity of each fuel injection valve 6, which is caused by a fluctuation in the battery voltage.

At step S6, a target fuel supply quantity (viz., fuel injection quantity) "Ti" is calculated from the following equation.

$$Ti=Tp(COEF-FLEAN)\alpha+Ts \quad (2)$$

At step S7, the calculated quantity "Ti" is practically set to an output register.

With these steps, at each given fuel injection time, a drive pulse signal having a pulse width corresponding to the calculated fuel injection quantity "Ti" is applied to each fuel injection valve 6, so that a fuel injection is actually made.

In the following, various embodiments of the present invention, for controlling a switching from a lean air/fuel ratio control to a stoichiometric air/fuel ratio control, will be described in detail with reference to flowcharts shown in corresponding drawings.

Figure 3:
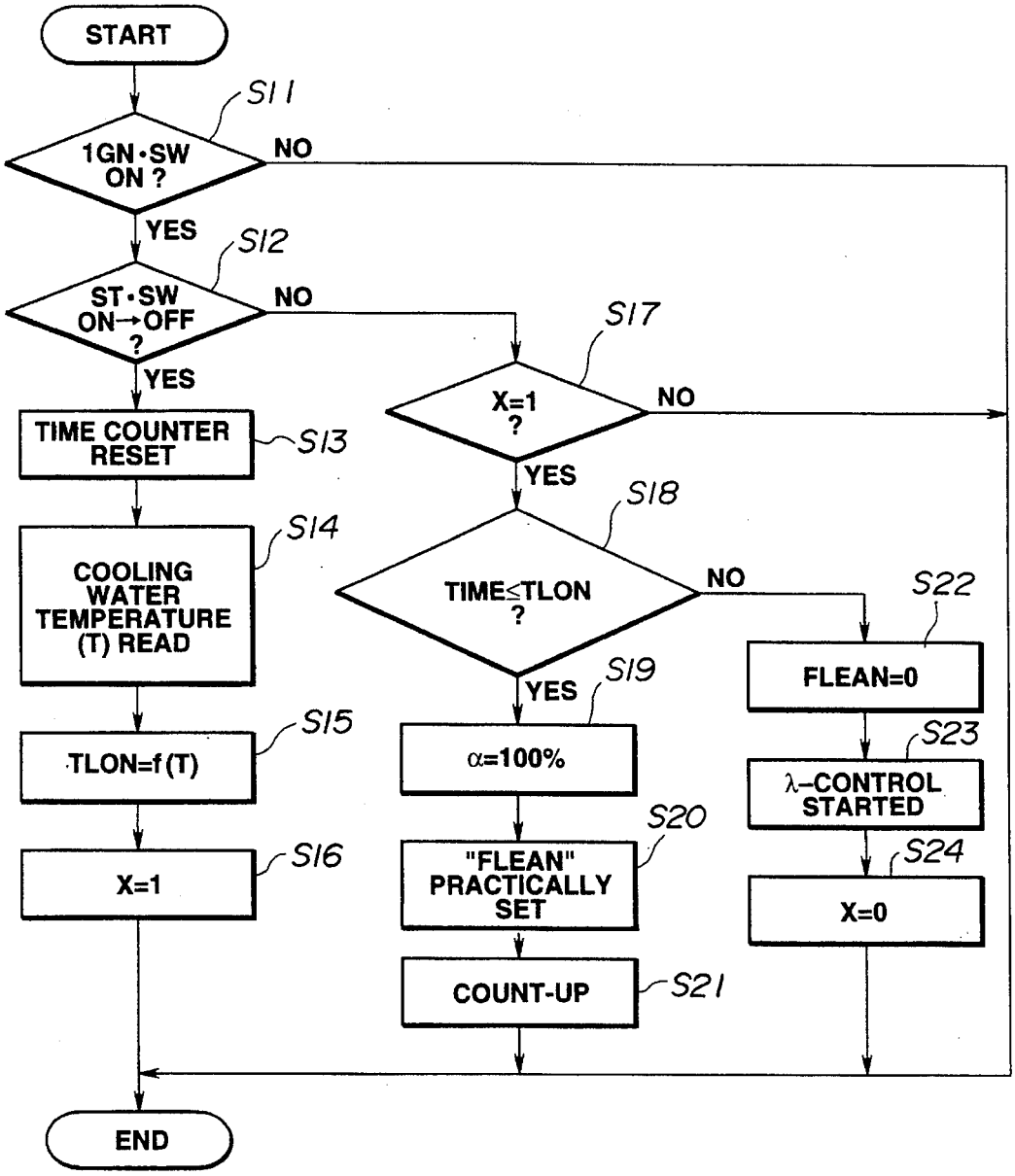
FIG. 3 is a flowchart of programmed operation steps carried out in an air/fuel ratio control system of a first embodiment of the present invention, for switching the engine control from a lean air/fuel ratio control to a stoichiometric air/fuel ratio control.

Referring to FIG. 3, there is shown a flowchart of operation steps which are carried out in a first embodiment of the present invention.

At step S11, a judgment is carried out as to whether an ignition switch is ON or not. If YES, that is, when the ignition switch is ON, the operation flow goes to step S12. While, if NO, that is, when the ignition switch is OFF, this routine is ended.

At step S12, a judgment is carried out as to whether an engine starter switch has been just turned ON or not, that is, whether the engine has been just started or not. If YES, that is, when the engine has been just started, the operation flow goes to step S13 to reset a time counter and then goes to step 14. At this step S14, the cooling water temperature "Tw" detected by the cooling water temperature sensor 15 is read. Of course, before being fed to the control unit 12, an analog signal from the sensor 15 is subjected to an A/D conversion. Then, at step S15, a lean air/fuel ratio keeping time "TLON", which is the time period for which a lean air/fuel ratio control should be kept from the engine start, corresponding to the detected temperature "Tw" of the engine cooling water is looked up from the map of FIG. 4. Then, at step S16, a lean flag "X" is set 1 (one).

If NO at step S12, the operation flow goes to step S17. At this step S17, a judgment is carried out as to whether the lean flag is 1 (one) or not. If YES, that is, when the lean flag is 1 (one), the operation flow goes to step S18. While, if NO, that is, when the lean flag is not 1 (one), the routine is ended.

At step S18, the time indicated by the time counter is compared with the lean air/fuel ratio keeping time "TLON". If the counted time is smaller or equal to the time "TLON", the operation flow goes to step S19 judging that lean air/fuel ratio keeping time does not reach the time for activating the catalyst of the converter 10, that is, judging that the catalyst is not in an activated state yet. Thus, at step S19, the feedback correction factor "α" is set to 100%, and then at step S20, the lean correction factor "FLEAN" looked up from the given map is practically set to carry out the lean air/fuel ratio control. Then, at step S21, a count-up is effected in the time counter.

If NO at step S18, that is, when the counted time is greater than the lean air/fuel ratio keeping time "TLON", the operation flow goes to step S22 judging that the lean air/fuel ratio keeping time has reached the time for activating the catalyst of the converter 10, that is, judging that the catalyst is in the activated state. Thus, at step S22, the lean correction factor "FLEAN" is set 0 (zero), and then at step S23, a λ-control (viz., stoichiometric air/fuel ratio control) is started. Then, at step S24, a λ-control flag X is set 0 (zero).

As is described hereinabove, in the first embodiment, the lean air/fuel ratio control and the stoichiometric air/fuel ratio control are switched based on the lean air/fuel ratio keeping time which is provided by considering the activity of the catalyst of the converter with respect to the temperature of engine cooling water during engine warm-up period. That is, until the time when the catalyst becomes sufficiently activated, a lean air/fuel ratio control is carried out for achieving reduction of NOx and promotion of activation of the catalyst, and once the catalyst becomes sufficiently activated, the control is automatically switched to a stoichiometric air/fuel ratio control for achieving the maximum conversion function of the catalyst of the converter. Accordingly, even when the engine operation condition at the warm-up time changes, the timing of switching from the lean air/furl ratio control to the stoichiometric air/fuel ratio control is adjusted automatically. Thus, the catalytic converter can always exhibit the satisfied purifying efficiency against the exhaust gas from the engine.

Figure 5:
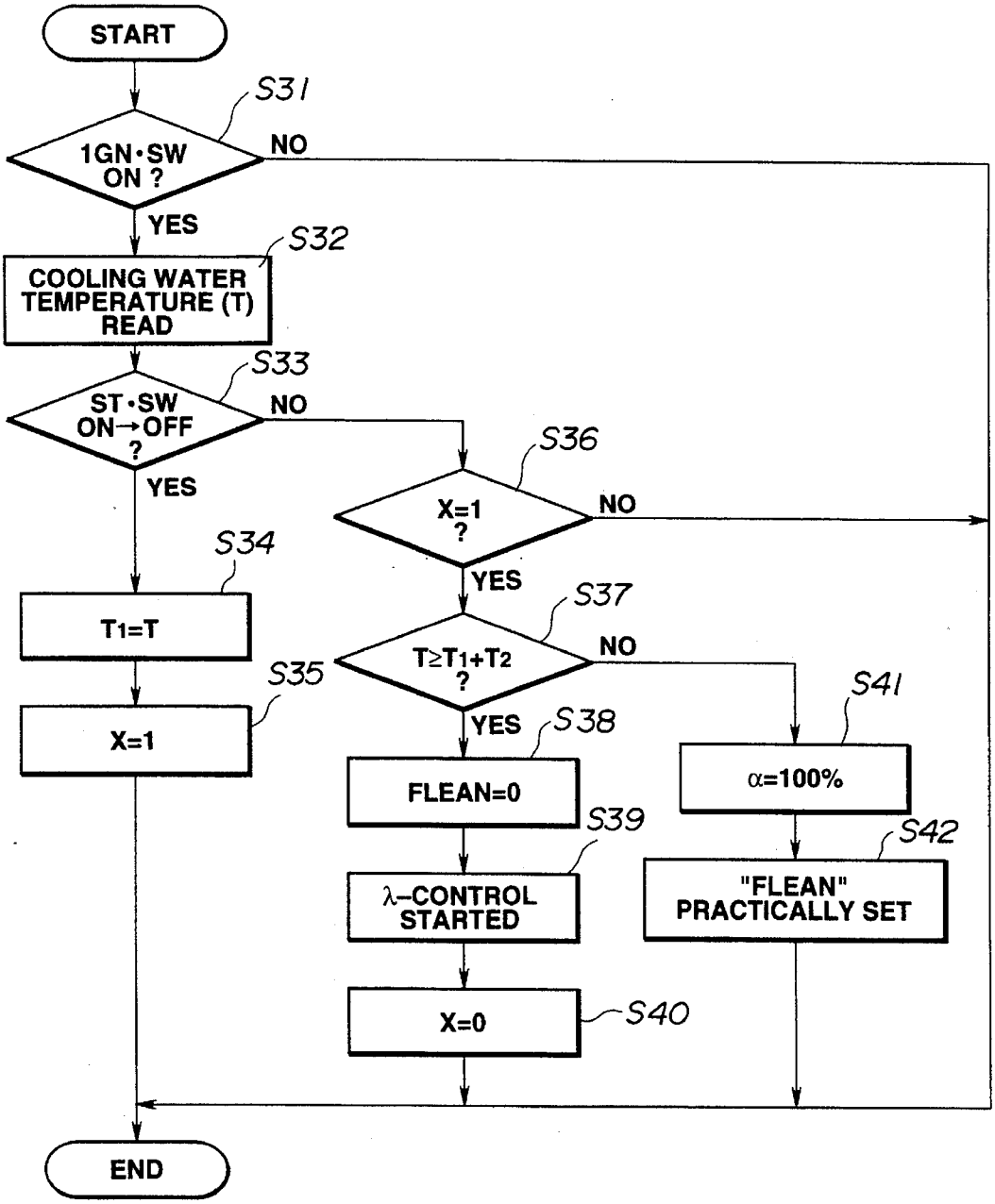
FIG. 5 is a flowchart similar to FIG. 3, but showing programmed operation steps carried out in a second embodiment of the present invention.

Referring to FIG. 5, there is shown a flowchart of operation steps which are carried out in a second embodiment of the present invention. Like in the above-mentioned first embodiment, the operation steps of the second embodiment constitute a routine for controlling a switching from a lean air/fuel ratio control to a stoichiometric air/fuel ratio control.

As will become apparent from the following description, in the second embodiment, the activity of the catalyst of the converter 10 is judged by the degree by which the temperature of the engine cooling water rises from the temperature indicated when the engine is just started.

At step S31, a judgment is carried out as to whether an ignition switch is ON or not. If YES, that is, when the ignition switch is ON, the operation flow goes to step S32. If NO, that is, when the ignition switch is OFF, this routine is ended.

At step S32, the temperature "T" of the engine cooling water, detected by the cooling water temperature sensor 15, is read. Then, at step S33, a judgment is carried out as to whether an engine starter switch has been just turned ON or not, that is, whether the engine has been just started or not. If YES, that is, when the engine has been just started, the operation flow goes to step S34 to set the detected cooling water temperature "T" as a reference temperature "T1". At step S35, a lean flag "X" is set 1 (one).

If NO at step S33, the operation flow goes to step S36. At this step S36, a judgment is carried out as to whether the lean flag "X" is 1 (one) or not. If YES, that is, when the lean flag "X" is 1 (one), the operation flow goes to step S37. While, if NO, that is, when the lean flag is not 1 (one), the routine is ended.

At step S37, a current temperature "T" of the engine cooling water, detected by the sensor 15, is compared with "T1 +T2". That is, at this step S37, a judgment is carried out as to whether the current temperature "T" of the engine cooling water is higher than the reference temperature "T1" by "T2" or not. The value of "T2" is determined as a difference between the reference temperature "T1" and a desired temperature of the cooling water which can induce the satisfied purifying efficiency of the catalytic converter 10. This determination is based on the assumption that the temperature-rise of the exhaust gas, which induces the activated state of the catalytic converter 10, is proportional to the temperature-rise of the engine cooling water. That is, at step S37, a judgment is carried out as to whether or not the current temperature of the exhaust gas, which is proportional to the current temperature "T" of the cooling water, has come to a certain degree which is sufficient for activating the catalyst of the converter 10.

If "T≧T1+T2" is established at step S37, the operation flow goes to step S38 judging that due to temperature-rise of the engine cooling water, the temperature of the exhaust gas has increased to the certain degree for the activation of the converter 10. At step S38, the lean correction factor "FLEAN" is set 0 (zero), and then at step S39, a λ-control (viz., stoichiometric air/fuel ratio control) is started. Then, at step S40, a λ-control flag "X" is set 0 (zero).

While, if "T<T1+T2" is established at step S37, the operation flow goes to step S41 judging that the temperature-rise of the engine cooling water is still insufficient for activating the catalyst of the converter 10. At step S41, the feedback correction factor "α" is set to 100%, and then at step S42, the lean correction factor "FLEAN" looked up from the given map is practically set to carry out the lean air/fuel ratio control.

Figure 4:
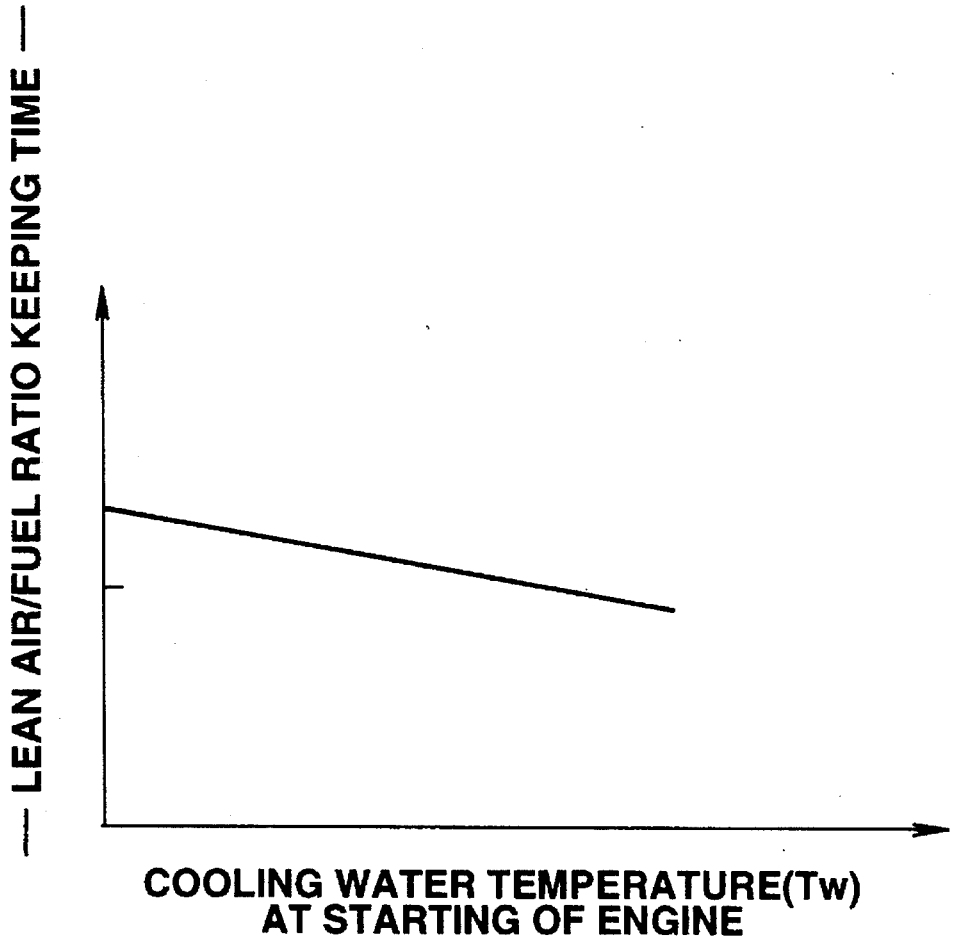
FIG. 4 is a map showing the relationship between the temperature of engine cooling water at engine start and the time period for which the lean air/fuel ratio control should be kept.

As is described hereinabove, in the second embodiment, the lean air/fuel ratio control and the stoichiometric air/fuel ratio control are switched based on the degree by which the current temperature of the engine cooling water rises from the cooling water temperature indicated when the engine is just started. Thus, in the second embodiment, a similar advantage to the first embodiment is obtained. Furthermore, in the second embodiment, means corresponding to the map of FIG. 4 is not needed, so that the routine for controlling the operation mode switching is simple as compared with that of the first embodiment.

Figure 6:
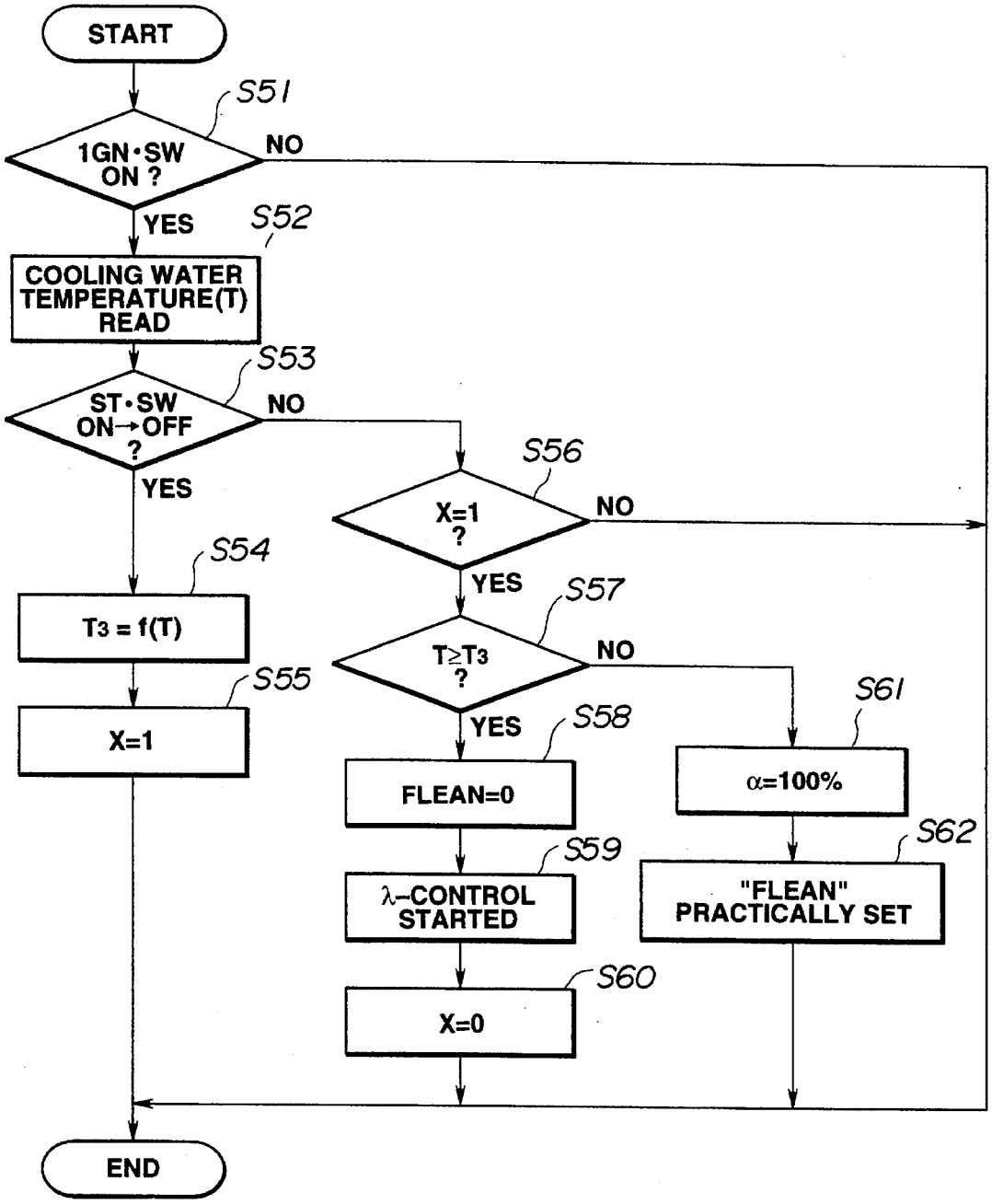
FIG. 6 is a flowchart similar to FIG. 3, but showing programmed operation steps carried out in a third embodiment of the present invention.

Referring to FIG. 6, there is shown a flowchart of operation steps which are carried out in a third embodiment of the present invention. Like in the above-mentioned first and second embodiments, the operation steps of the third embodiment constitute a routine for controlling a switching from a lean air/fuel ratio control to a stoichiometric air/fuel control.

As will become apparent from the following description, in the third embodiment, the activity of the catalyst of the converter 10 is judged by the temperature (viz., terminal temperature) of engine cooling water which is indicated when the lean air/fuel ratio control should be ended. The terminal temperature is looked up from a given map which shows a relationship between the temperature of cooling water indicated when the engine is just started and the temperature indicated when a lean air/fuel ratio control should be ended.

At step S51, a judgment is carried out as to whether an ignition switch is ON or not. If YES, that is when the ignition switch is ON, the operation flow goes to step S52. If NO, that is, when the ignition switch is OFF, this routine is ended.

At step S52, the temperature "T" of the engine cooling water, detected by the cooling water temperature sensor 15, is read. Then, at step S53, a judgment is carried out as to whether an engine starter switch has been just turned ON or not, that is, whether the engine has been just started or not. If YES, that is, when the engine has been just started, the operation flow goes to step S54. At this step, based on the temperature "T" read at step S52, the "terminal temperature" "T3" Of the engine cooling water indicated when the lean air/fuel ratio control should be ended is looked up from the given map, and at step S55, the lean flag "X" is set 1 (one).

If NO at step S53, that is, when the engine has not been just started, that is, when the engine is under a warm-up condition, the operation flow goes to step S56. At this step, a judgment is carried out as to whether the lean flag "X" is 1 (one) or not. If YES, that is, when the lean flag "X" is 1 (one), the operation flow goes to step S57. While, if NO, that is, when the lean flag "X" is not 1 (one), the routine is ended.

At step S57, a current temperature "T" of the engine cooling water, detected by the sensor 15, is compared with the terminal temperature "T3". That is, at step S57, a judgment is carried out as to whether or not the current temperature "T" of the engine cooling water has reached the terminal temperature, that is, whether or not the temperature-rise of the engine cooling water is sufficient for activating the catalyst of the converter 10.

If "T≧T3" is established at step S57, the operation flow goes to step S58 judging that the catalyst of the converter 10 has been activated. At step S58, the lean correction factor "FLEAN" is set 0 (zero), and then at step S59, a λ-control (viz., stoichiometric air/fuel ratio control) is started. Then, at step S60, a λ-control flag "X" is set 0 (zero).

While, if "T<T3" is established at step S57, operation flow goes to step S61 judging that the catalyst of the converter 10 has not been activated yet. At step S61, the feedback correction factor "α" is set to 100%, and at step S68, the lean correction factor "FLEAN" is practically set to carry out the lean air/fuel ratio control.

As is described hereinabove, in the third embodiment, the lean air/fuel ratio control and the stoichiometric air/fuel ratio control are switched based on the terminal temperature of engine cooling water which is indicated when the lean air/fuel ratio control should be ended. Thus, in the third embodiment, a similar advantage to the first and second embodiments are obtained. Furthermore, in the third embodiment, due to employment of the given map from which the terminal temperature "T3" is looked up, much more fine switching control is carried out for reducing the exhaust emission.

Figure 7:
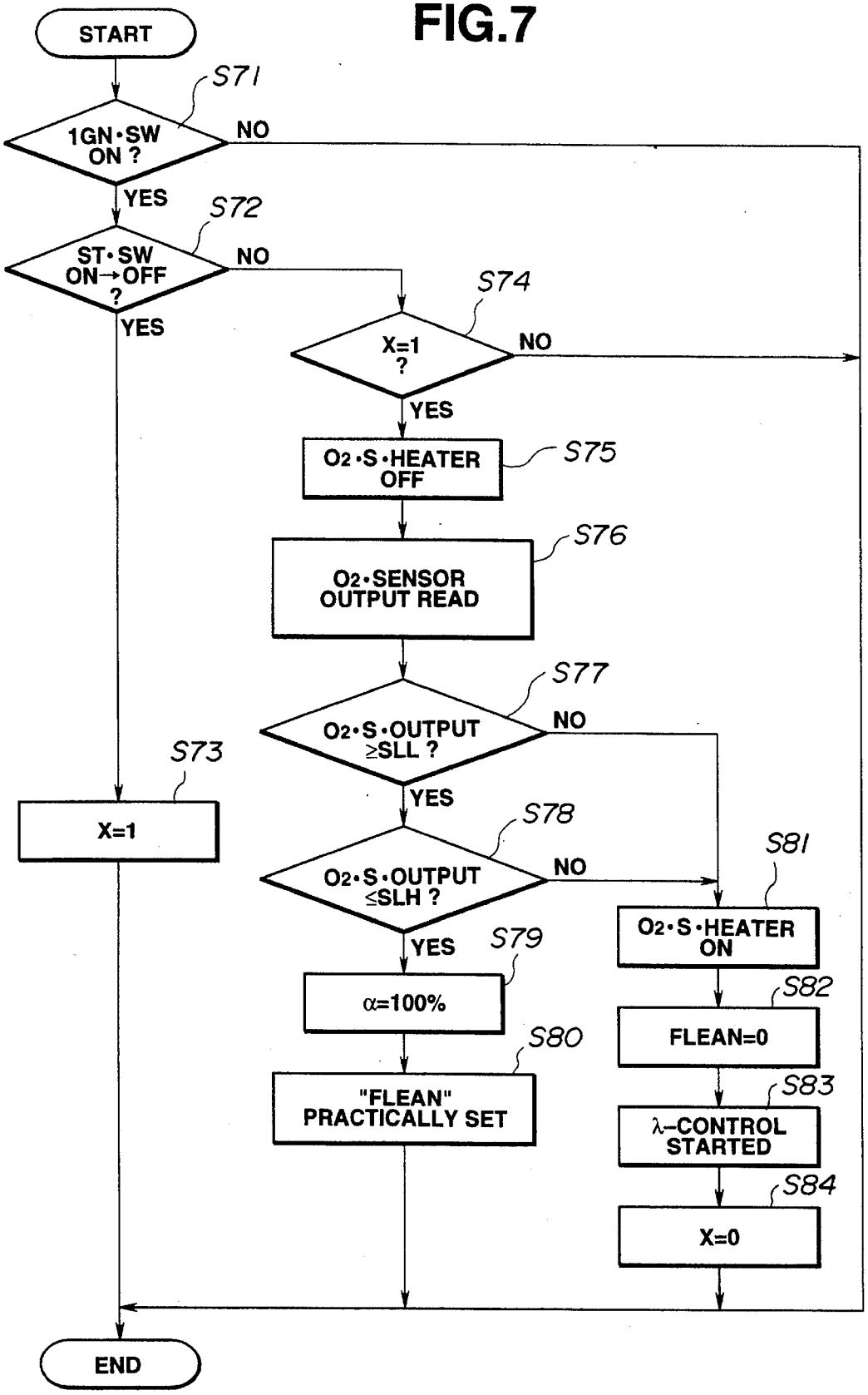
FIG. 7 is a flowchart similar to FIG. 3, but showing a fourth embodiment of the present invention.

Referring to FIG. 7, there is shown a flowchart of operation steps which are carried out in a fourth embodiment of the present invention. Like in the above-mentioned first, second and third embodiments, the operation steps of the fourth embodiment constitute a routine for controlling a switching from a lean air/fuel ratio control to a stoichiometric air/fuel ratio control.

As will become apparent from the following description, in the fourth embodiment, the activity of the catalyst of the converter 10 is judged by the activity of the oxygen sensor 31. This judgment is based on the assumption that the oxygen sensor 31 has a function similar to the converter 10 having an oxidation catalyst.

At step S71, a judgment is carried out as to whether an ignition switch is ON or not. If YES, that is, when the ignition switch is ON, the operation flow goes to step S72. If NO, that is, when the ignition switch is OFF, this routine is ended.

At step S72, a judgment is carried out as to whether an engine starter switch has been just turned ON or not, that is, whether the engine has been just started or not. If YES, that is, when the engine has been just started, the operation flow goes to step S73. At this step, the lean flag "X" is set 1 (one).

If NO at step S72, that is, when the engine has not been just started, that is, when the engine is under a warm-up condition, the operation flow goes to step S74. At this step, a judgment is carried out as to whether the lean flag "X" is 1 (one) or not. If YES, that is, when the lean flag "X" is 1 (one), the operation flow goes to step S75. While, if NO, that is, when the lean flag "X" is not 1 (one), the routine is ended.

At step S75, a heater for the oxygen sensor 31 is turned OFF, and then at step S76, the output of the oxygen sensor 31 is read. Of course, before being fed to the control unit 12, the analog output signal from the sensor 31 is subjected to an A/D conversion. Then, the operation flow goes to step S77 to compare the output from the sensor 31 with a lower slice level "SLL".

Figure 8:
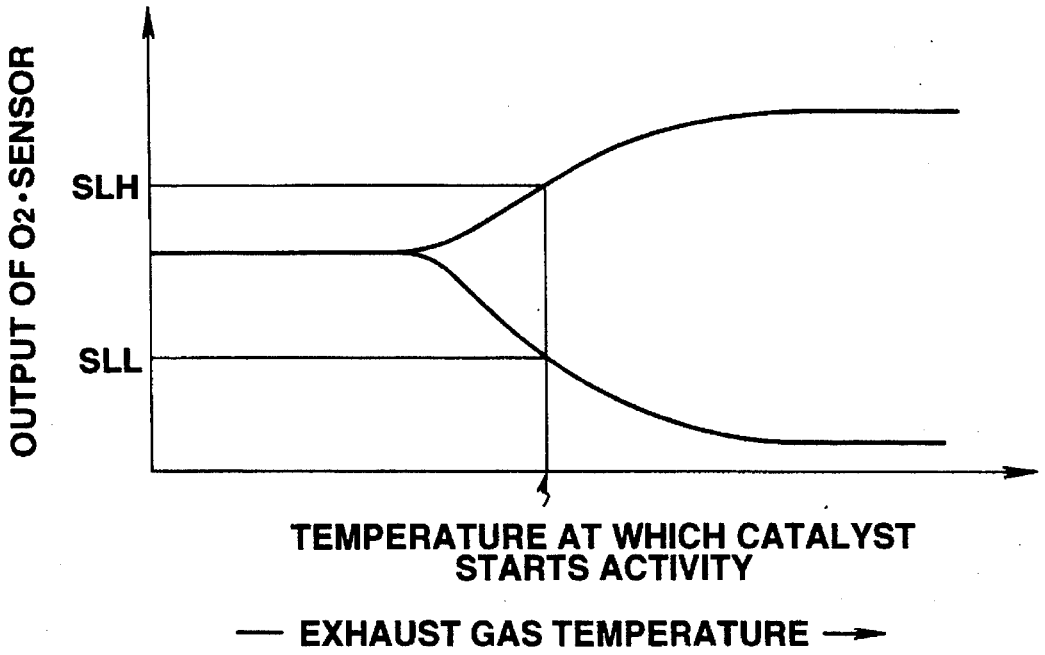
FIG. 8 is a graph showing the characteristic of an oxygen sensor.

The relationship between the output from the oxygen sensor 31, lower and higher slice levels "SLL" and "SLH" and the exhaust gas temperature at which the catalyst of the converter 10 exhibits a satisfied purifying performance is shown by a map of FIG. 8.

If the output is greater than or equal to the lower slice level "SLL", the operation flow goes to step S78. While, if the output is smaller than the lower slice level "SLL", the operation flow goes to step S81 judging that the oxygen sensor 31 has been sufficiently activated already.

At step S78, the output from the oxygen sensor 31 is compared with a higher slice level "SLH". If the output is smaller than or equal to the higher slice level "SLH", the operation flow goes to step S79. At this step, the feedback correction factor "α" is set to 100%, and then at step S80, the lean correction factor "FLEAN" is practically set to carry out the lean air/fuel ratio control. While, if, at step S78, the output of the sensor 31 is greater than the higher slice level "SLH", the operation flow goes to step S81 judging that the oxygen sensor 31 has been sufficiently activated.

At step S81, the heater of the oxygen sensor 31 is turned ON because of the judgment that the oxygen sensor 31 has been activated. Based on the assumption that, due to the activated state of the oxygen sensor 31 thus judged, also the catalyst of the converter 10 has been activated, the operation flow goes to-step S82 to set the lean correction factor "FLEAN" to 0 (zero). Then, at step F83, a λ-control (viz., stoichiometric air/fuel ratio control) is started. Then, at step S84, a λ-control flag X is set 0 (zero).

As is described hereinabove, in the fourth embodiment, the lean air/fuel ratio control and the stoichiometric air/fuel ratio control are switched based on the activity of the oxygen sensor 31 which has a close relation with the activated condition of the catalyst of the converter 10.

Figure 10:
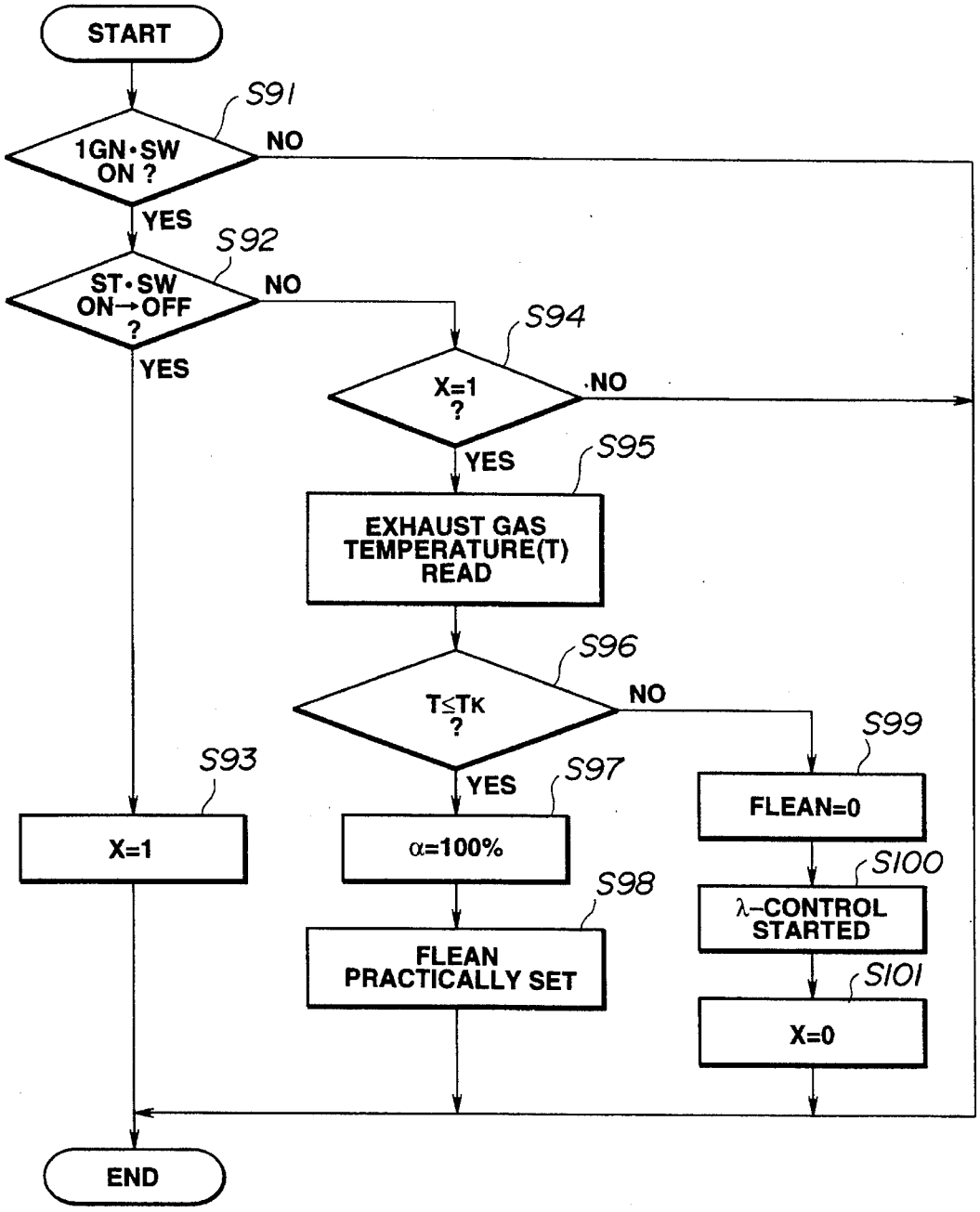
FIG. 10 is a flowchart similar to FIG. 3, but showing the fifth embodiment.

Referring to FIG. 10, there is shown a flowchart of operation steps which are carried out in a fifth embodiment of the present invention. Like in the above-mentioned embodiments, the operation steps of the fifth embodiment constitute a routine for controlling a switching from a lean air/fuel ratio control to a stoichiometric air/fuel ratio control.

Figure 9:
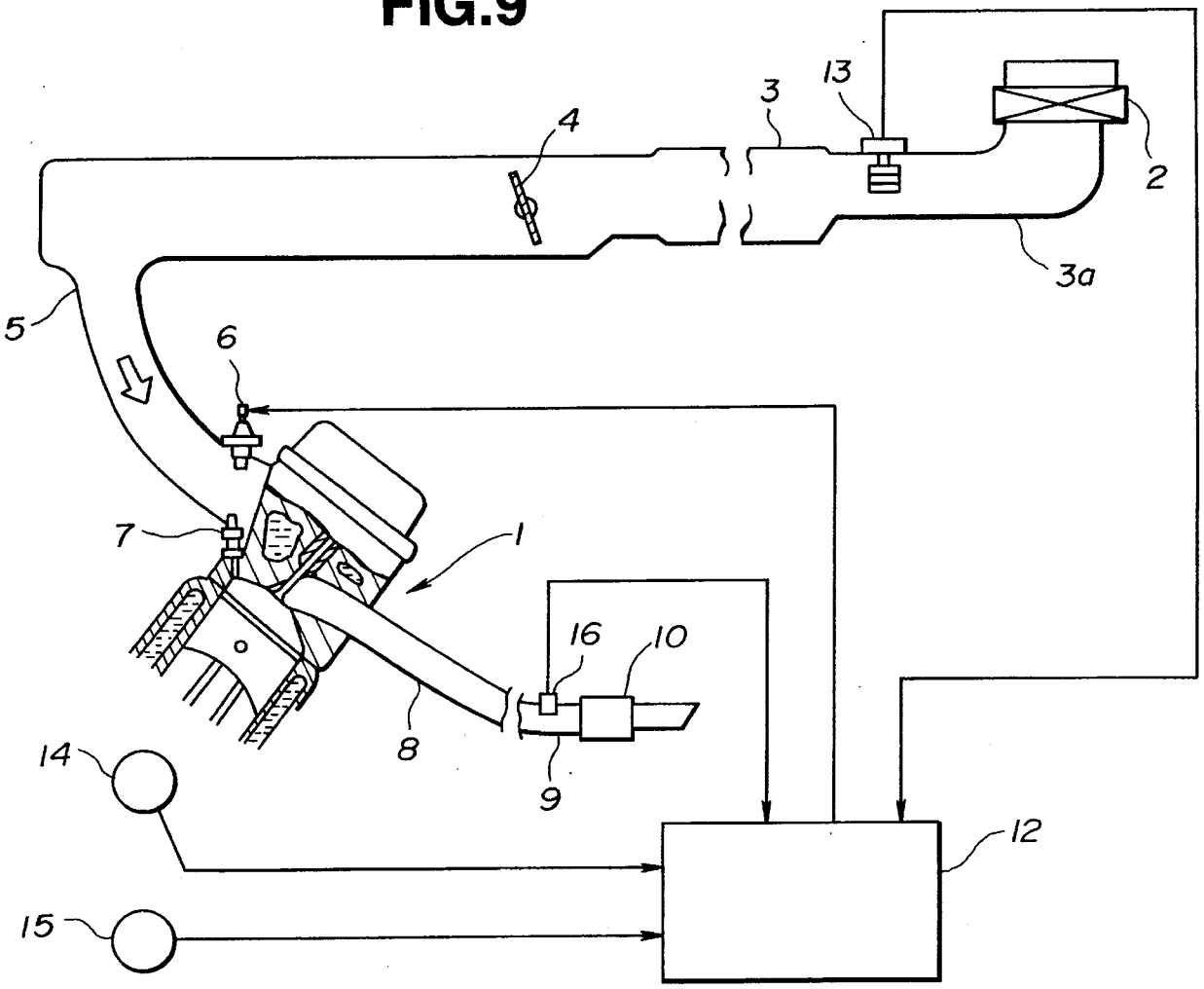
FIG. 9 is a view similar to FIG. 1, but showing an internal combustion engine system incorporated with an air/fuel ratio control system of a fifth embodiment of the present invention.

As will become apparent from the following description, in the fifth embodiment, the activity of the catalyst of the converter 10 is judged by the temperature of exhaust gas from the engine 1. This judgment is based on the fact that the activated condition of the catalyst of the converter 10 has a close relation with the temperature of the exhaust gas. For this judgment, an exhaust gas temperature sensor 16 is employed in place of the oxygen sensor 31 as is understood from FIG. 9.

At step S91, a judgment is carried out as to whether an ignition switch is ON or not. If YES, that is, when the ignition switch is ON, the operation flow goes to step S92. While, if NO, that is, when the ignition switch is OFF, this routine is ended.

At step S92, a judgment is carried out as to whether an engine starter switch has been just turned ON or not, that is, whether the engine has been just started or not. If YES, that is, when the engine has been just started, the operation flow goes to step S93. At this step, the lean flag "X" is set 1 (one).

If NO at step S92, that is, when the engine has not been just started, that is, when the engine is under a warm-up condition, the operation flow goes to step S94. At this step, a judgment is carried out as to whether the lean flag "X" is 1 (one) or not. If YES, that is, when the lean flag "X" is 1 (one), the operation flow goes to step S95. While, if NO, that is, when the lean flag "X" is not 1 (one), the routine is ended.

At step S95, the output "T" from the exhaust gas temperature sensor 16 is read. Of course, before being fed to the control unit 12, the analog output signal from the temperature sensor 16 is subjected to an A/D conversion. Then, the operation flow goes to step S96 to compare the detected exhaust gas temperature "T" with a predetermined temperature "Tk".

If "T≦Tk" is established, the operation flow goes to step S97 judging that, due to insufficient temperature-rise of exhaust gas, the catalyst of the converter 10 has not been sufficiently activated. At step S97, the feedback correction factor "α" is set to 100% and then at step S98, the lean correction factor "FLEAN" is practically set-to carry out the lean air/fuel ratio control.

If "T>Tk" is established at step S96, the operation flow goes to step S99 judging that, due to sufficient temperature-rise of exhaust gas, the catalyst of the converter 10 has been sufficiently activated. At step S99, the lean correction factor "FLEAN" is set 0 (zero) and then at step S100, a λ-control (viz., stoichiometric air/fuel ratio control) is started. Then, at step S101, a λ-control flag "X" is set 0 (zero).

As is described hereinabove, in the fifth embodiment, the lean air/fuel ratio control and the stoichiometric air/fuel ratio control are switched based on the temperature of the exhaust gas which has a close relation with the activated condition of the catalyst of the converter 10.

What is claimed is:

1. In an internal combustion engine having a three-way catalytic converter in an exhaust line thereof, an air/fuel ratio control system comprising:

lean air/fuel ratio control means for feeding the engine with a mixture of a desired lean air/fuel ratio for a given time from the time on which the engine is started;

stoichiometric air/fuel ratio control means for feeding the engine with a mixture of a substantially stoichiometric air/fuel ratio once said given time passes;

temperature sensing means for sensing the temperature of cooling water of the engine at the time when the engine is just started; and control switching means for varying said given time in accordance with the temperature sensed by said temperature sensing means.

2. An air/fuel ratio control system as claimed in claim 1, in which said control switch means varies said given time in accordance with a lean air/fuel ratio keeping time which is derived by considering the activity of the three-way catalytic converter with respect to the temperature sensed by said temperature sensing means.

3. An air/fuel ratio control means as claimed in claim 1, in which said control switch means varies said given time in accordance with the degree by which the temperature of the engine cooling water rises from the temperature sensed by said temperature sensing means.

4. An air/fuel ratio control means as claimed in claim 1, in which said control switch means varies said given time in accordance with the temperature of engine cooling water sensed by said temperature sensing means when the lean air/fuel ratio control should be ended.

5. In an internal combustion engine having a three-way catalytic converter and an oxygen sensor in an exhaust line thereof, an air/fuel ratio control system comprising:

lean air/fuel ratio control means for feeding the engine with a mixture of a desired lean air/fuel ratio for a given time from the time on which the engine is started;

stoichiometric air/fuel ratio control means for feeding the engine with a mixture of a substantially stoichiometric air/fuel ratio once said given time passes;

activity sensing means for sensing the activity of said oxygen sensor; and control switching means for varying said given time in accordance with the oxygen sensor activity sensed by said activity sensing means.

6. In an internal combustion engine having a three-way catalytic converter and an exhaust gas temperature sensor in an exhaust line thereof, an air/fuel ratio control system comprising:

lean air/fuel ratio control means for feeding the engine with a mixture of a desired lean air/fuel ratio for a given time from the time on which the engine is started;

stoichiometric air/fuel ratio control means for feeding the engine with a mixture of a substantially stoichiometric air/fuel ratio once said given time passes;

temperature sensing means for sensing the temperature of exhaust gas from the engine; and control switching means for varying said given time in accordance with the exhaust gas temperature sensed by said temperature sensing means.

* * * * *